United States Patent [19]

Egan

[11] Patent Number: 4,467,692

[45] Date of Patent: Aug. 28, 1984

[54] STRINGED MUSICAL INSTRUMENT WITH IMPROVED BASE AND SOUND BOX

[76] Inventor: William H. Egan, 3234 Ellington Dr., Los Angeles, Calif. 90068

[21] Appl. No.: 453,351

[22] Filed: Dec. 27, 1982

[51] Int. Cl.[3] ..... G10D 3/02

[52] U.S. Cl. ..... 84/291; D17/19

[58] Field of Search ..... D17/14, 19; 84/173, 84/267, 291, 292

[56] References Cited

U.S. PATENT DOCUMENTS

| | | | |
|---|---|---|---|
| D. 83,426 | 2/1931 | Bremerman | D17/19 |
| D. 207,506 | 4/1967 | Krager | D17/14 |
| D. 219,618 | 12/1970 | Appleton | D17/14 |
| 536,846 | 4/1895 | Bates | 84/291 |
| 1,959,530 | 5/1934 | Gerber | 84/291 |
| 4,090,427 | 5/1978 | Kaman | 84/291 |

FOREIGN PATENT DOCUMENTS

| | | | |
|---|---|---|---|
| 956466 | 6/1957 | Fed. Rep. of Germany | 84/291 |
| 2312766 | 9/1974 | Fed. Rep. of Germany | 84/291 |
| 1038740 | 10/1953 | France | 84/268 |

*Primary Examiner*—Lawrence R. Franklin

*Attorney, Agent, or Firm*—Thomas A. Fournie

[57] ABSTRACT

Disclosed is a string musical instrument suitable for use as a guitar having a hollow base with outer and inner ends, the instrument neck extending from the base inner end. The base defines the instrument sound box; is disclosed having front and back surfaces members interconnected along their outer edges by a side wall, the front surface member being formed as a planar member which functions as a sound board; and is shaped to define inner and outer end portions of, respectively, greater and smaller widths interconnected by a narrowing middle portion, thereby the base's smaller outer end portion adapts to a person's body to facilitate the holding and playing of same. The base further is disclosed with sound hole or holes formed in its inner end portion at the widest portion thereof to increase the region in the guitar base for concentrically generating sound and enhance its sound generating characteristics.

14 Claims, 7 Drawing Figures

STRINGED MUSICAL INSTRUMENT WITH IMPROVED BASE AND SOUND BOX

BACKGROUND OF THE INVENTION

The present invention relates to stringed musical instruments and more particularly to a stringed musical instrument suitable for use as a guitar having an improved base and sound box.

The sound box of a guitar is generally defined by the shape of the guitar's base. In prior art guitars, their bases generally vary in width along their length with a conventional guitar's base being widest across its outer end portion.

The aforementioned shape and configuration of a conventional guitar base has several drawbacks. Firstly, such a conventional guitar is cumbersome to hold and awkward to play since its wide outer base portion must be held clamped against a person's body under his armpit and has to be reached around in order to play same. As a consequence, a person playing same tends to contort his body and unnaturally raise the shoulder of his playing arm in order to adapt to the awkwardness of having the wide portion of the guitar base positioned under his arm and wedged into his armpit.

Further, in such conventional guitars, the sound hole is not located in the widest portion of the guitar base, but rather at a point along its length where the guitar is substantially narrower. As a result, the narrow width of the guitar base at the sound hole location has the effect of limiting the area therein available for the concentric generation of sounds and tones, and thus detrimentally affects the level and quality of the sound generated in the guitar base, emitted from its sound hole and outputted by the guitar.

SUMMARY OF INVENTION

It is an object of the present invention to provide an improved stringed musical instrument suitable for use as a guitar which obviates the aforementioned disadvantages and drawbacks of the prior art.

It is further an object of the present invention to provide such an improved stringed musical instrument characterized by having its base shaped to naturally and comfortably adapt to the body of a person holding and playing such instrument.

It is additionally an object of the present invention to provide such an improved stringed musical instrument further characterized by having the sound hole in its base positioned so as to efficiently utilize the width of the guitar's base and thereby improve the quality and level of sound emitted therefrom.

In accomplishing these and other objects, there is provided a stringed musical instrument suitable for use as a guitar made up of a hollow base having an outer and inner end, neck structure mounted on one end to extend from the base inner end and carrying string tuning mechanism on its other end, and strings mounted to extend from the base along the neck to the string tuning mechanism. The hollow base defines a sound box and has front and back surface members interconnected along their outer edges by a side wall, the base front surface member being formed as a planar member which functions as a sound board. The guitar base is shaped to define base inner and outer end portions of predetermined different widths interconnected by a narrowing base middle or waist portion with the base outer end portion being substantially smaller than its inner end portion so as to adapt to the shape of a person's body and facilitate the holding and playing of same. In a first embodiment, the instrument base has a circular sound hole formed centrally in its inner end portion at the widest point with the center of the sound hole being located at a distance from the sides of the base greater than the distance to the base's inner end. Thereby, the region in the guitar base for generating concentric sound is increased and is not affected by the base's width, and the instrument's sound generating characteristics are enhanced and improved. In other embodiments, the instrument base is shown with different shapes and forms of sound holes.

Additional objects of the present invention reside in the specific construction of the exemplary stringed musical instrument and its bases hereinafter described in conjunction with the several drawings.

DETAILED DESCRIPTION OF THE PREFERRED EMBODIMENTS

Figure 1:
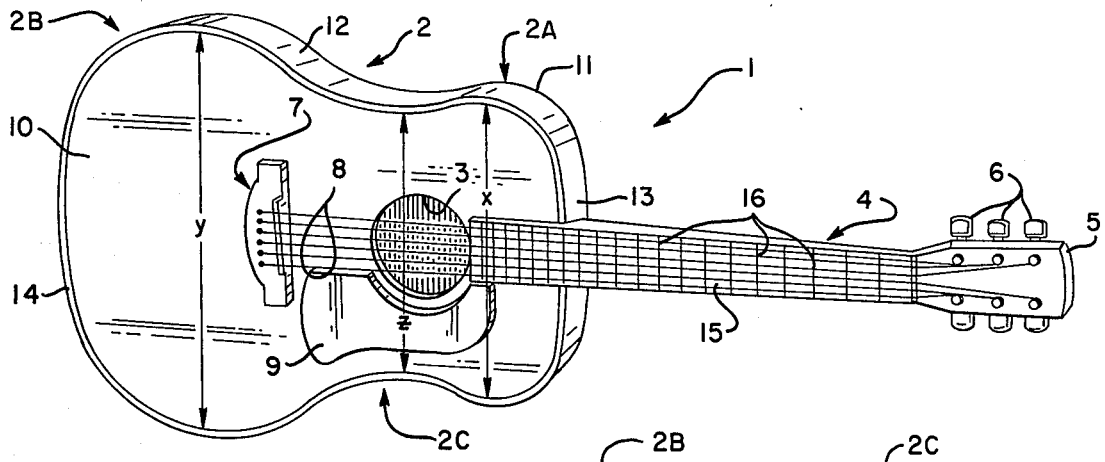
PRIOR ART FIG. 1
FIG. 1 is a perspective view of a conventional prior art guitar.

Referring to the drawings in more detail, a conventional prior art flat top guitar 1 is shown in FIG. 1. The guitar 1 is made up of a base 2 having a round sound hole 3 defined therein, neck structure 4, a tuning head 5 having string tuning peg mechanism 6 incorporated therein, a combined tail and bridge assembly 7, six strings 8 and guard apparatus 9.

The guitar base 2 is constructed in a conventional manner and is made of a front planar surface member 10 and a back slightly outwardly bowed surface member 11 which are joined together along their outer edges by a continuous side wall member 12. The side wall member 12 is disposed substantially normal to the planar member 10, and the planar member 10 defines the front face of the guitar base 2 and a sound board for the guitar 1, while the surface member 11 defines the base's back.

The guitar base 2, and its front and back members 10 and 11, are shaped to be symmetrical about their longitudinal axis and the guitar base 2 has inner and outer positioned ends 13 and 14, respectively. The guitar neck 4 is mounted to extend longitudinally from the guitar base inner end 13.

The guitar base inner and outer ends 13 and 14 are each substantially flat and each extends substantially perpendicularly to the longitudinal axis of the guitar 1. The guitar base 2 may be considered to be formed in three sections, which are designated in FIG. 1 as end portions 2A and 2B and an interconnecting middle or waist portion 2C.

Guitar base portion 2A defines its inner end and is shaped to curve outwardly from the flat end wall 13 to a maximum width of dimension X. The guitar base end portion 2B defines its outer end and is shaped to curve outwardly from the flat end wall 14 to a maximum width of dimension Y, which dimension Y is substantially greater than the maximum width X of the inner end portion 2A. The base middle portion 2C curves inwardly from the maximum widths of both end portions 2A and 2B to define the waist and narrowest width Z of the guitar body 2. The width dimension Z is narrower than the width X of the body inner end portion 2A.

The guitar neck structure or neckpiece 4 is conventional in construction and has a fingerboard 15 formed on its front surface. Formed on the fingerboard 15 are a plurality of transverse1y extending frets 16 longitudinally spaced apart along the length of the neck 4 in a conventional manner.

The guitar tail and bridge assembly 7 is conventional in construction and is mounted on the front member 10 of the guitar base 2 substantially midway between its ends 13 and 14 to extend transversely across the coincident longitudinal axes of the guitar 1 and guitar base 2 in a symmetrical and normal disposition thereto. The sound hole 3 is circular in shape and has its centerpoint located on the longitudinal axis of the guitar base 2 and guitar 1 substantially midway between the tail and bridge assembly 7 and the guitar base inner end 13, thereby being positioned in the narrowest portion of the guitar base 2 near its narrowest width point Z.

The six guitar strings 8 are attached on one end to the tail assembly 7 to extend longitudinally therefrom in a spaced apart disposition across the string bridge defined by the assembly 7 and are attached on their other ends in a conventional manner to the appropriate tuning peg mechanisms 6 so that the strings 8 may be adjusted to proper tension thereby. The guard apparatus 9, which is a substantially flat plate, is secured to the guitar body front face defined by planar member 10 adjacent to and below the sound hole 3 to protect the guitar base front face 10 from being scratched by a guitar pick utilized by a person playing and strumming the guitar strings 8, or the person's fingernails.

Figure 2:
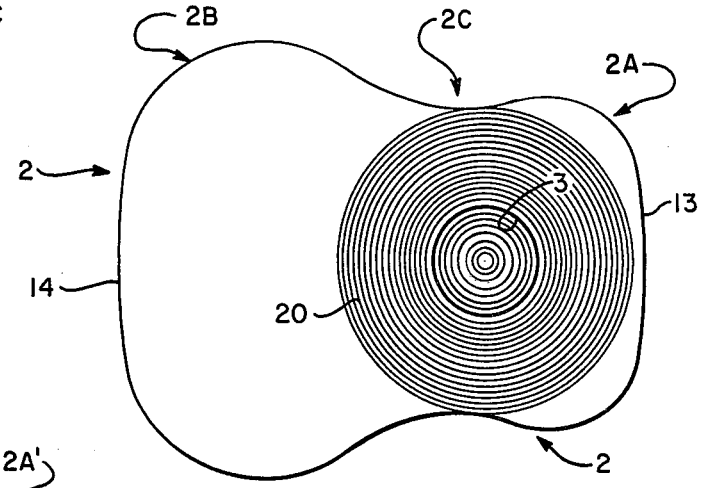
PRIOR ART FIG. 2
FIG. 2 is a plan view of the base of the conventional guitar of FIG. 1 illustrating how sounds and tones are concentrically generated therein.

In playing the guitar 1, which is a right handed guitar, the guitar neck 4 would be gripped by a player's left hand while the wide outer end portion of the guitar base 2 adjacent its widest width point Y would be awkwardly forced under the player's right arm into his armpit. Playing and strumming of the guitar strings 8 would then cause the concentric generation of sound waves and tones 20, as shown in FIG. 2, which are emitted from the sound hole 3. As shown in FIG. 2, the hollow guitar base 2 defines the guitar's sound box and the area available therein for generating concentric sound is effectively limited by the narrowest width Z of the guitar base 2.

Figure 3:
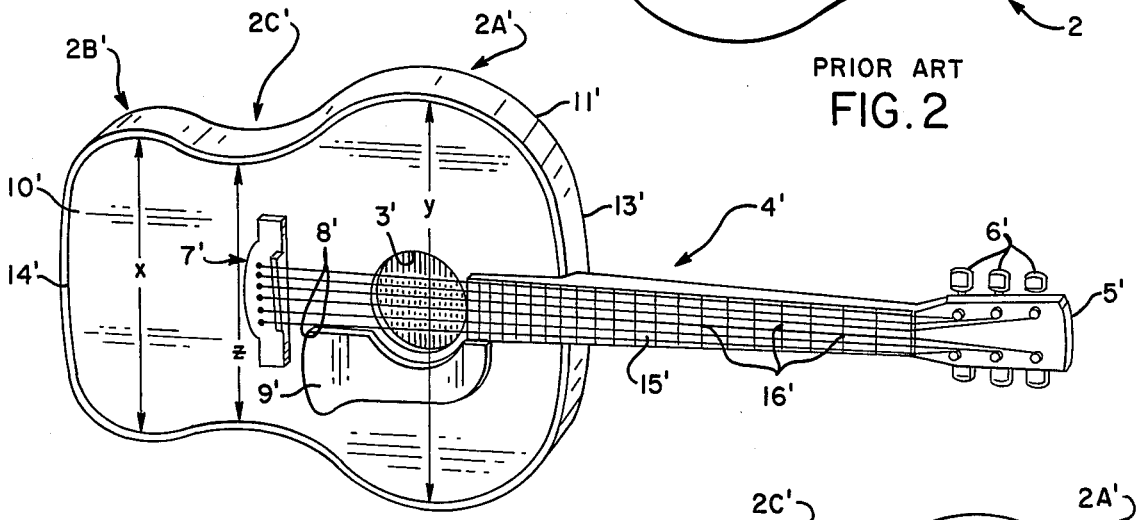
FIG. 3 is a perspective view of a stringed musical instrument suitable for use as a guitar according to the present invention having a base with a circular sound hole defined therein.
Figure 4:
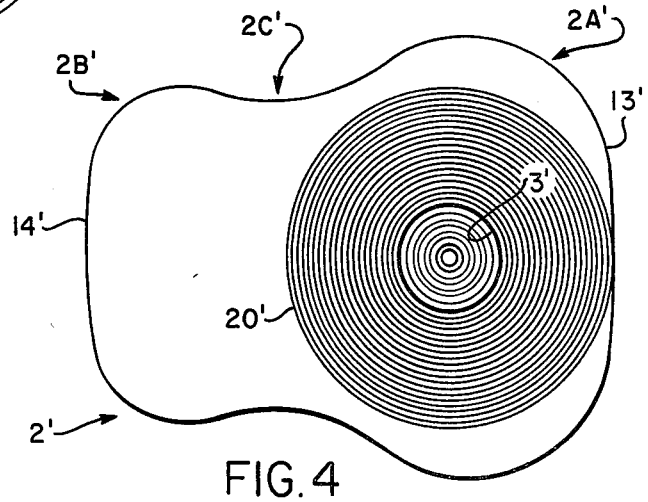
FIG. 4 is a plan view of the body of the guitar of FIG. 3 illustrating how sounds and tones are concentrically generated therein.

FIGS. 3 and 4 show a stringed musical instrument 1' constructed in accordance with the present invention and suitable for use as a guitar. The instrument 1' is constructed, with the hereinafter noted differences, like the guitar 1 and similar parts of the instrument 1' are designated by the same numerals, with a prime added, hereinbefore utilized in describing the guitar 1.

The instrument 1' and its base 2' are constructed differently from the conventional guitar base 2 of FIG. 1 in the following respects. Firstly, the front and back members 10' and 11' are shaped to be substantially the mirror image of the members 10 and 11. As a consequence, the base inner end 2A' curves outwardly to the maximum width dimension Y while the base outer end 2B' curves outwardly to the substantially narrower width dimension X.

Secondly, the instrument base 2' differs from that of the guitar 1 of FIG. 1 by having its circular sound hole 3' substantially centrally positioned on the base inner end 2A at the maximum width dimension X of the base 2' instead of at the minimum width dimension Z as in the conventional guitar of FIG. 1.

As a result of the aforementioned differences in the construction of the instrument 1', an improved guitar type instrument is provided having a narrower base outer end 2B' and cooperating middle base curvature 2C' which is shaped to easily and naturally fit under a player's arm and against a player's armpit and shoulder, thereby to facilitate the playing of same.

Further, as shown in FIG. 4, the hollow sound box defined by the instrument base 2', and specifically its end portion 2A', has an increased area available therein for generating concentric sounds. As a consequence, it has been found that the instrument 1' can generate truer sounds and notes 20' of greater resonance and which are sustained longer than those produced by the prior art guitar 1. Additionally, it is noted, as shown in FIG. 4, that the area in the base 2' for concentrically generating the sounds emitted from the circular sound hold 3' is not limited at any point by the width of the base 2'. Rather, the center of the sound hold 3' is located at a selected distance from the side walls of the base 2' which is greater than its distance from the inner end wall of the guitar base 2' so as to provide no such restriction.

For purposes of illustration, an instrument constructed in accordance with the present invention and like the instrument 1' shown in FIGS. 3 and 4 had the following dimensions. The width dimensions X, Y and Z were approximately 11½", 16" and 11", respectively. The total length of the guitar 1' was approximately 31¼", with the base being 19¾" long. The side wall 13' was 4" at the neck, 4 3/16" at the width point Y, 4½" at width point Z, 4⅝" at width point X and about 4⅝" at the base outer end. The bottom surface 11' of the base 2' was slightly convex or bowed outwardly and twenty frets 16' were formed on the fingerboard 15', having a spacing of about 1⅝" at the top of the neck which gradually decreases to about ⅜" adjacent the sound hole 3'. The sound hole was about 4" in diameter and the distance from the sound hole centerpoint to the base inner end 13' about 5¾". The bridge 7' was located about 11" from the base inner end 13'.

Figure 5:
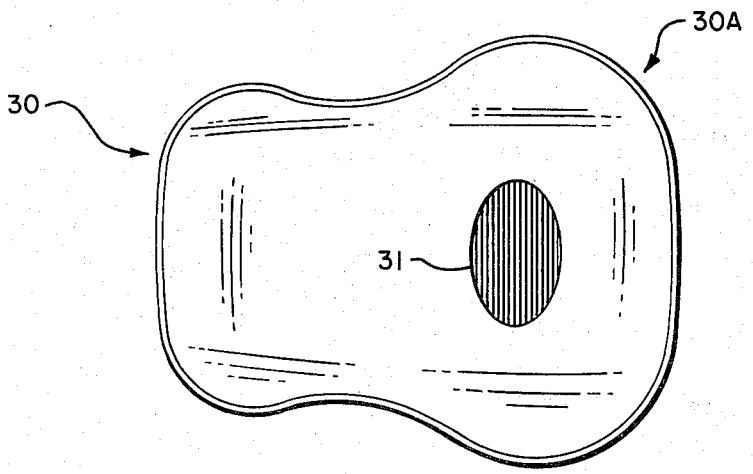
FIGS. 5, 6 and 7 are plan views of a guitar base constructed like that of the guitar of FIG. 3 illustrated having different shaped sound holes defined therein.
Figure 6:
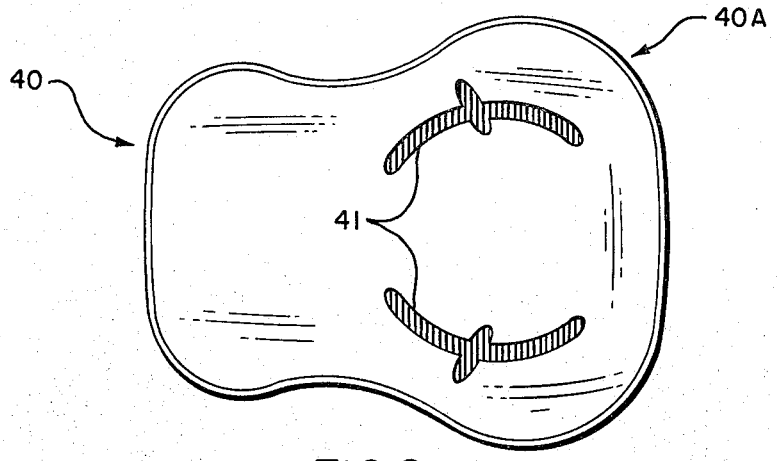
Figure 7:
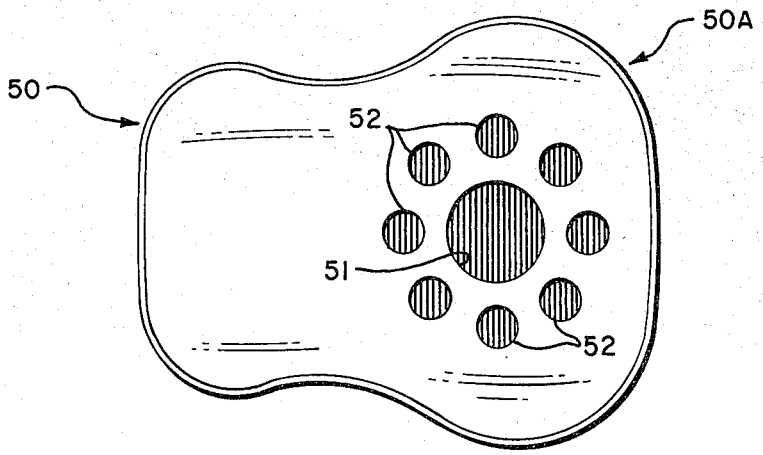

Referring to FIGS. 5, 6 and 7, alternate bases 30, 40 and 50 are shown for the instrument 1' which are constructed according to the present invention. With the exception of the sound hole or holes defined therein each of the bases 30, 40 and 50 are constructed like the instrument base 2'.

With reference to FIG. 5, the instrument base 30 has an oval sound hole 31 substantially centrally positioned on the inner end portion 30A at approximately the point of maximum width of the base 30.

Similarly, in FIG. 6, F-holes 41 are concentrically defined in the instrument base inner end portion 40A in the region of the base 40 of maximum width.

Likewise, in FIG. 7, a concentric sound hole 51, with a plurality of smaller sound holes 52 concentrically positioned therearound, are shown defined in and centrally positioned on the instrument base inner end portion 50A at approximately the point of maximum width of the base 50.

Although the invention has herein been shown and described in what is conceived to be the most practical and preferred embodiments, it is recognized that departures may be made therefrom within the scope of the invention.

I claim:

1. In a stringed musical instrument suitable for use as a guitar, the improvement of base means defining a hollow sound box, said base means being comprised of front and back surface members interconnected along their outer edges by side wall means and being shaped to define base inner and outer end portions of predetermined different widths interconnected by a narrowing base middle portion, said base outer end portion having a smaller width than said guitar base inner end portion whereby said guitar base means adapts to the shape of a person's body so as to facilitate the holding and playing of same.

2. The invention defined in claim 1, wherein:

said front surface member is substantially planar; and including:

sound hole means centrally disposed in said front surface member in the inner end portion thereof to enhance the sound generating characteristics of the sound box defined by said base means.

3. The invention defined in claim 1, wherein said front surface member is substantially planar and has sound hole means formed therein centrally in said base inner end portion at substantially the widest portion thereof whereby to enhance the sound generating characteristics of the sound box defined by said base means.

4. The invention defined in claim 3, wherein said sound hole means is formed by a circular hole.

5. The invention defined in claim 3, wherein said sound hole means is formed by one larger circular hole surrounded by a plurality of concentrically disposed smaller circular holes.

6. The invention defined in claim 2, wherein said sound hole means is formed by an oval hole.

7. The invention defined in claim 2, wherein said sound hole means is formed by a pair of F-holes.

8. The invention defined in claim 1, wherein said side wall means is disposed normal to said front surface member.

9. The invention defined in claim 8, wherein said front surface member is substantially planar and has sound hole means formed therein centrally in said base inner end portion at substantially the widest portion thereof whereby to enhance the sound generating characteristics of the sound box defined by said base means.

10. The invention defined in claim 9, wherein said sound hole means is defined by a circular hole centrally located in said base inner end portion with its center located at a distance from the sides of said base means at least as great as the distance from its inner end.

11. A stringed musical instrument suitable for use as a guitar comprised of base means having a longitudinal axis and inner and outer ends, neck structure mounted to extend longitudinally from the inner end of said base means, and string means for playing said instrument mounted to extend from said base means along said neck structure, said base means defining a hollow sound box and being comprised of front and back surface members interconnected along their outer edges by side wall means and being shaped to define base inner and outer end portions of predetermined different widths interconnected by a narrowing base middle portion, said base outer end portion having a smaller width than said guitar base inner end portion whereby said guitar base means adapts to the shape of a person's body so as to facilitate the holding and playing of same.

12. In a stringed musical instrument suitable for use as a guitar, the improvement of base means defining a hollow sound box, said base means being shaped to have inner and outer end portions of, respectively, greater and smaller widths whereby said base smaller outer end adapts to a person's body to facilitate the holding and playing of same.

13. The invention defined in claim 12, including sound hole means centrally disposed in said base larger inner end portion to enhance the sound generating characteristics of the sound box defined by said base means.

14. The invention defined in claim 13, wherein said sound hole means is defined by a circular hole centrally located in said base inner end portion with its center located at a distance from the sides of said base means at least as great as the distance from its inner end.

* * * * *